US011625054B2

(12) United States Patent
Chiu

(10) Patent No.: US 11,625,054 B2
(45) Date of Patent: Apr. 11, 2023

(54) VOLTAGE TO CURRENT CONVERTER OF IMPROVED SIZE AND ACCURACY

(71) Applicant: NOVATEK Microelectronics Corp., Hsin-Chu (TW)

(72) Inventor: Hsiang-Yi Chiu, Hsinchu (TW)

(73) Assignee: NOVATEK Microelectronics Corp., Hsin-Chu (TW)

( * ) Notice: Subject to any disclaimer, the term of this patent is extended or adjusted under 35 U.S.C. 154(b) by 36 days.

(21) Appl. No.: 17/349,940

(22) Filed: Jun. 17, 2021

(65) Prior Publication Data

US 2022/0404849 A1 Dec. 22, 2022

(51) Int. Cl.

| | |
|---|---|
| ***G05F 1/56*** | (2006.01) |
| ***G05F 1/59*** | (2006.01) |
| *G05F 1/575* | (2006.01) |

(52) U.S. Cl.

CPC ..... *G05F 1/561* (2013.01); *G05F 1/59* (2013.01); *G05F 1/575* (2013.01)

(58) Field of Classification Search

CPC ..... G05F 1/462; G05F 1/465; G05F 1/468; G05F 1/56; G05F 1/575; G05F 1/562; G05F 1/565; G05F 1/567; G05F 1/569; G05F 1/571; G05F 1/573; G05F 1/5735

See application file for complete search history.

(56) References Cited

U.S. PATENT DOCUMENTS

| | | | | |
|---|---|---|---|---|
| 5,917,311 | A * | 6/1999 | Brokaw | G05F 1/573 323/280 |
| 6,765,374 | B1 * | 7/2004 | Yang | G05F 1/575 323/280 |
| 7,017,767 | B2 * | 3/2006 | Eijkelenberg | B65D 90/36 137/68.19 |
| 7,619,402 | B1 * | 11/2009 | Kwong | G05F 1/575 323/369 |
| 7,639,067 | B1 * | 12/2009 | Perisetty | G05F 1/56 326/41 |
| 7,728,569 | B1 * | 6/2010 | Le | G05F 1/575 323/280 |

(Continued)

FOREIGN PATENT DOCUMENTS

| | | | |
|---|---|---|---|
| CN | 102722209 | A | 10/2012 |
| CN | 10312510 | * | 5/2013 |

(Continued)

*Primary Examiner* — Thienvu V Tran
*Assistant Examiner* — Nusrat Quddus
(74) *Attorney, Agent, or Firm* — Winston Hsu

(57) ABSTRACT

A voltage-to-current converter includes a first transistor having a drain coupled to a first node, a second transistor having a drain coupled to the first node, an operational amplifier having a first input terminal configured to receive a reference voltage and a second input terminal coupled to a source of the first transistor or a source of the second transistor, a control circuit having an input terminal coupled to an output terminal of the operational amplifier, a first output terminal coupled to a gate of the first transistor, and a second output terminal coupled to a gate of the second transistor, a first resistor coupled between the source of the first transistor and a ground, and a second resistor coupled between the source of the second transistor and the ground. An output current of the voltage-to-current converter is generated from the first node.

19 Claims, 9 Drawing Sheets

(56) References Cited

U.S. PATENT DOCUMENTS 7,804,284 B1 * 9/2010 Wong ..... G05F 1/46 323/281
8,421,426 B2 * 4/2013 La Rosa ..... H05B 45/397 323/317
9,018,576 B2 * 4/2015 Gong ..... G05F 1/10 250/214 R
9,317,054 B2 * 4/2016 Pons ..... G05F 1/575
9,459,642 B2 * 10/2016 Chen ..... G05F 1/575
9,489,004 B2 * 11/2016 Huang ..... G05F 1/10
9,710,003 B2 * 7/2017 El-Nozahi ..... G05F 1/565
9,791,880 B2 * 10/2017 Kumbaranthodiyil ..... G05F 3/185
9,933,801 B1 * 4/2018 Guan ..... G05F 1/575
10,261,538 B2 * 4/2019 Ono ..... G05F 3/267
10,310,528 B1 * 6/2019 Elsayed ..... G05F 1/575
10,845,835 B1 * 11/2020 Lai ..... G05F 1/575
11,029,716 B1 * 6/2021 Chan ..... G05F 1/575
2005/0242796 A1 * 11/2005 Yang ..... G05F 1/575 323/282
2006/0082412 A1 * 4/2006 D'Angelo ..... G05F 1/577 327/541
2006/0232326 A1 * 10/2006 Seitz ..... G11C 11/4076 327/539
2008/0246537 A1 * 10/2008 Aziz ..... G05F 1/56 327/540
2009/0243571 A1 * 10/2009 Cook ..... G05F 1/575 323/280
2010/0019744 A1 * 1/2010 Kim ..... G05F 1/561 323/269
2010/0066345 A1 * 3/2010 Terry ..... H02J 7/0031 323/371
2011/0156670 A1 * 6/2011 Tadeparthy ..... G05F 1/56 323/273
2012/0038332 A1 * 2/2012 Lin ..... G05F 1/575 323/277
2012/0154027 A1 * 6/2012 Liao ..... H03H 7/38 327/543
2013/0069608 A1 * 3/2013 Gakhar ..... G05F 1/575 323/273
2013/0234685 A1 * 9/2013 Thoka ..... H03F 3/45475 323/282
2013/0307502 A1 * 11/2013 Bhattacharyya ..... G05F 1/565 323/282
2013/0320881 A1 * 12/2013 Cozzolino ..... G05F 1/56 315/307
2014/0097816 A1 * 4/2014 Chen ..... G05F 1/575 323/283
2014/0176098 A1 * 6/2014 Fang ..... G05F 1/46 323/280
2014/0247028 A1 * 9/2014 Pons ..... G05F 1/575 323/281
2014/0320229 A1 * 10/2014 Ali ..... H03H 11/30 333/17.3
2015/0061623 A1 * 3/2015 Lee ..... G05F 1/575 323/280
2015/0185746 A1 * 7/2015 Wang ..... G05F 1/468 323/313
2015/0381176 A1 * 12/2015 Schie ..... H03K 19/0005 327/108
2016/0070277 A1 * 3/2016 Price ..... G05F 1/46 324/123 R
2016/0094195 A1 * 3/2016 Du ..... H03F 3/193 330/254
2016/0147239 A1 * 5/2016 Yan ..... G05F 1/575 323/280
2016/0187900 A1 * 6/2016 Dhiman ..... G05F 1/46 323/281
2017/0026037 A1 * 1/2017 Huang ..... G05F 1/56
2017/0052552 A1 * 2/2017 Mahmoudi ..... G05F 1/575
2017/0214374 A1 * 7/2017 Tajalli ..... H03G 3/3089
2018/0120875 A1 * 5/2018 Suzuki ..... H03K 17/08
2019/0004554 A1 * 1/2019 Mochida ..... G05F 1/56
2019/0041890 A1 * 2/2019 Chen ..... H03F 3/189
2019/0212762 A1 * 7/2019 Heo ..... G05F 1/575
2019/0278312 A1 * 9/2019 Lin ..... G05F 1/575
2020/0073425 A1 * 3/2020 Wang ..... H02M 3/158
2021/0124383 A1 * 4/2021 Iguchi ..... G05F 1/565
2022/0019253 A1 * 1/2022 Zukowski ..... G05F 1/468
2022/0057469 A1 * 2/2022 Fortuny ..... G01R 1/30

FOREIGN PATENT DOCUMENTS

CN 103123510 A 5/2013
CN 106796438 A 5/2017
EP 1 003 281 B1 1/2008

* cited by examiner

VOLTAGE TO CURRENT CONVERTER OF IMPROVED SIZE AND ACCURACY

BACKGROUND OF THE INVENTION

1. Field of the Invention

The present invention relates to a voltage-to-current converter, and more particularly, to a voltage-to-current converter so as to reduce the size of the voltage-to-current converter and improve the accuracy drop caused by the mismatch.

2. Description of the Prior Art

A voltage-to-current converter converts a reference voltage into an output current. As the trend of smaller size is spreading throughout technology, the industry has aimed to shrink a voltage-to-current converter but maintain its performance. However, as transistors/switches get smaller, it eventually becomes difficult to meet the specification requirements of resistance.

Besides, small variations may occur during fabrication processes and result in variations of the electrical characteristics of transistors/switches. For example, the transistors/switches may be mismatched and have different resistances. The output current may deviate from the intended target, such that the accuracy of the voltage-to-current converter may be degraded. Consequently, there is still room for improvement when it comes to a voltage-to-current converter to supplying the output current stably regardless of the mismatch of the transistors/switches.

SUMMARY OF THE INVENTION

In order to solve aforementioned problem(s), the present invention provides a voltage-to-current converter of smaller size and scarcely any accuracy drop caused by the mismatch.

The present invention discloses a voltage-to-current converter, comprising a first transistor, having a drain coupled to a first node, wherein an output current of the voltage-to-current converter is generated from the first node; a second transistor, having a drain coupled to the first node; an operational amplifier, having a first input terminal configured to receive a reference voltage and a second input terminal coupled to a source of the first transistor or a source of the second transistor; a control circuit, having an input terminal coupled to an output terminal of the operational amplifier, a first output terminal coupled to a gate of the first transistor, and a second output terminal coupled to a gate of the second transistor; a first resistor, coupled between the source of the first transistor and a ground; and a second resistor, coupled between the source of the second transistor and the ground.

The present invention further discloses a voltage-to-current converter, comprising a first transistor, having a drain coupled to a first node, wherein an output current of the voltage-to-current converter is generated from the first node; an operational amplifier, having an output terminal coupled to a gate of the first transistor and a first input terminal configured to receive a reference voltage; a first resistor, having a first terminal coupled to a ground and a second terminal coupled to a source of the first transistor, wherein the second terminal of the first resistor is also coupled to a second input terminal of the operational amplifier or a first input terminal of a determination circuit coupled to the second input terminal of the operational amplifier; and a second resistor, having a first terminal coupled to the ground and a second terminal, wherein the second terminal of the second resistor is coupled to a third input terminal of the operational amplifier or a second input terminal of the determination circuit.

The present invention further discloses a voltage-to-current converter, comprising a first transistor, having a drain coupled to a first node, wherein an output current of the voltage-to-current converter is generated from the first node; a second transistor, having a drain coupled to the first node; an operational amplifier, having a first input terminal configured to receive a reference voltage; a control circuit, having an input terminal coupled to an output terminal of the operational amplifier, a first output terminal coupled to a gate of the first transistor, and a second output terminal coupled to a gate of the second transistor; a first resistor, having a first terminal coupled to a ground and a second terminal coupled to a source of the first transistor, wherein the second terminal of the first resistor is also coupled to a second input terminal of the operational amplifier or a first input terminal of a determination circuit coupled to the second input terminal of the operational amplifier; and a second resistor, having a first terminal coupled to the ground and a second terminal coupled to a source of the second transistor, wherein the second terminal of the second resistor is also coupled to a third input terminal of the operational amplifier or a second input terminal of the determination circuit.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
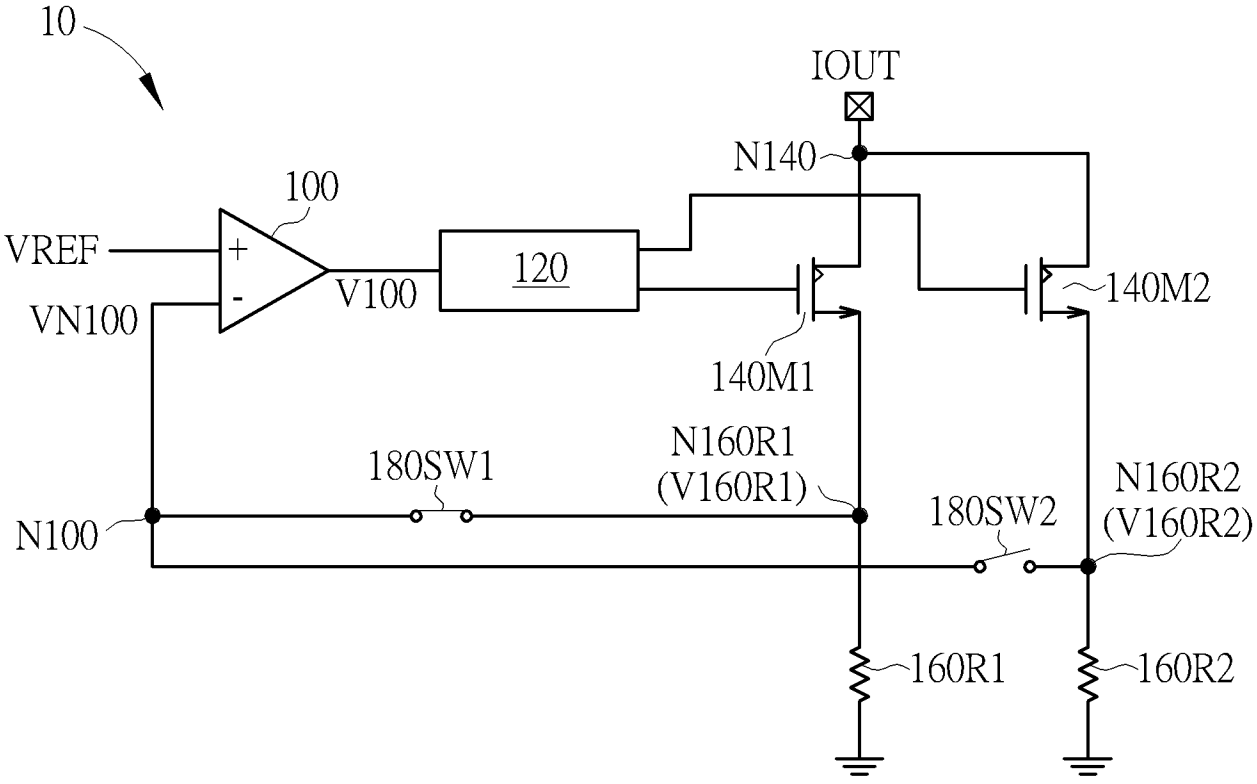
FIG. 1 to FIG. 6 are schematic diagrams of voltage-to-current converters according to embodiments of the present invention.

FIG. 1 is a schematic diagram of a voltage-to-current converter 10 according to an embodiment of the present invention. The voltage-to-current converter 10 includes an operational amplifier 100, a control circuit 120, transistors 140M1, 140M2, resistors 160R1, 160R2, and switches 180SW1, 180SW2.

The operational amplifier 100 is configured to output an output voltage V100 in response to a reference voltage VREF and a node voltage VN100 of a node N100. The reference voltage VREF is applied to a positive input terminal of the operational amplifier 100. The node voltage VN100 is applied to a negative input terminal of the operational amplifier 100. An output terminal of the operational amplifier 100 is (directly) connected to an input terminal of the control circuit 120.

The control circuit 120 is configured to control the gate of the transistor 140M1 or the gate of the transistor 140M2 with the output voltage V100 so as to turn on either the transistor 140M1 or 140M2. An output terminal of the control circuit 120 is coupled to the gate of the transistor 140M1; another output terminal of the control circuit 120 is coupled to the gate of the transistor 140M2. The control circuit 120 switches between the transistors 140M1 and 140M2, such that a node N140 from which the output current IOUT of the voltage-to-current converter 10 is generated is routed to the resistor 160R1 or 160R2.

The transistors 140M1, 140M2 are configured to change the equivalent resistance (detailed later) by using the resistors 160R1, 160R2. The gate of the transistor 140M1 or the gate of the transistor 140M2 is routed to the output terminal of the operational amplifier 100 by the control circuit 120. The drains of the transistors 140M1 and 140M2 are coupled to the node N140 providing the output current IOUT. The source of the transistor 140M1 is coupled (or electrically/directly connected) to one terminal N160R1 of the resistor 160R1, the other terminal of which is grounded. The source of the transistor 140M2 is coupled (or electrically/directly connected) to one terminal N160R2 of the resistor 160R2, which has the other terminal grounded. Feedback loops may further couple the sources of the transistors 140M1 and 140M2 to the negative input terminal of the operational amplifier 100.

The switches 180SW1, 180SW2 correspond to the transistors 140M1, 140M2 respectively. The switch 180SW1 within one feedback loop is coupled between the source of the transistor 140M1 and the negative input terminal of the operational amplifier 100. The switch 180SW2 within another feedback loop is coupled between the source of the transistor 140M2 and the negative input terminal of the operational amplifier 100. The switch 180SW1 or 180SW2 may be turned on/off at the same time that the transistor 140M1 or 140M2 is turned on/off. The switch 180SW1 may be turned on/off in response to whether the transistor 140M1 is turned on/off; the switch 180SW2 may be turned on/off in response to whether the transistor 140M2 is turned on/off.

Voltage-to-current conversion is accomplished by maintaining the reference voltage VREF across the resistor 160R1 or 160R2 using the operational amplifier 100. The reference voltage VREF transmitted to the positive input terminal of the operational amplifier 100 also appears at the node N100 (and thus be applied to the resistor 160R1 or 160R2). The output current IOUT may then be expressed as IOUT=VREF/Req, where Req is the equivalent resistance corresponding to the resistor 160R1 or 160R2. A straightforward way to implement adjustable output current IOUT is to make the equivalent resistance Req adjustable.

The transistors 140M1, 140M2 and the switches 180SW1, 180SW2 are programmably switchable to vary the equivalent resistance Req (and thus the output current IOUT). The equivalent resistance Req may be equal to the resistance (referred to as r160R1) of the resistor 160R1 when the transistor 140M1 (and the switch 180SW1) is/are turned on but the transistor 140M2 (and the switch 180SW2) is/are turned off. The equivalent resistance Req may be equal to the resistance (referred to as r160R2) of the resistor 160R2 when the transistor 140M1 (and the switch 180SW1) is/are turned off but the transistor 140M2 (and the switch 180SW2) is/are turned on. In an embodiment, the equivalent resistance Req may be equal to the reciprocal of the sum of the reciprocals of the resistances of the resistors 160R1 and 160R2 (namely, 1/(1/r160R1+1/r160R2)) when the transistors 140M1, 140M2 (and the switches 180SW1, 180SW2) are turned on (namely, shorted or closed). The output current IOUT may maximize when the control circuit 120 turns on both the resistors 160R1 and 160R2. In another embodiment, if the output current IOUT is requested to double, the equivalent resistance Req may become half by switching on the transistors 140M1, 140M2 (and the switches 180SW1, 180SW2) corresponding to the resistors 160R1 and 160R2 of the same resistances.

Figure 2:
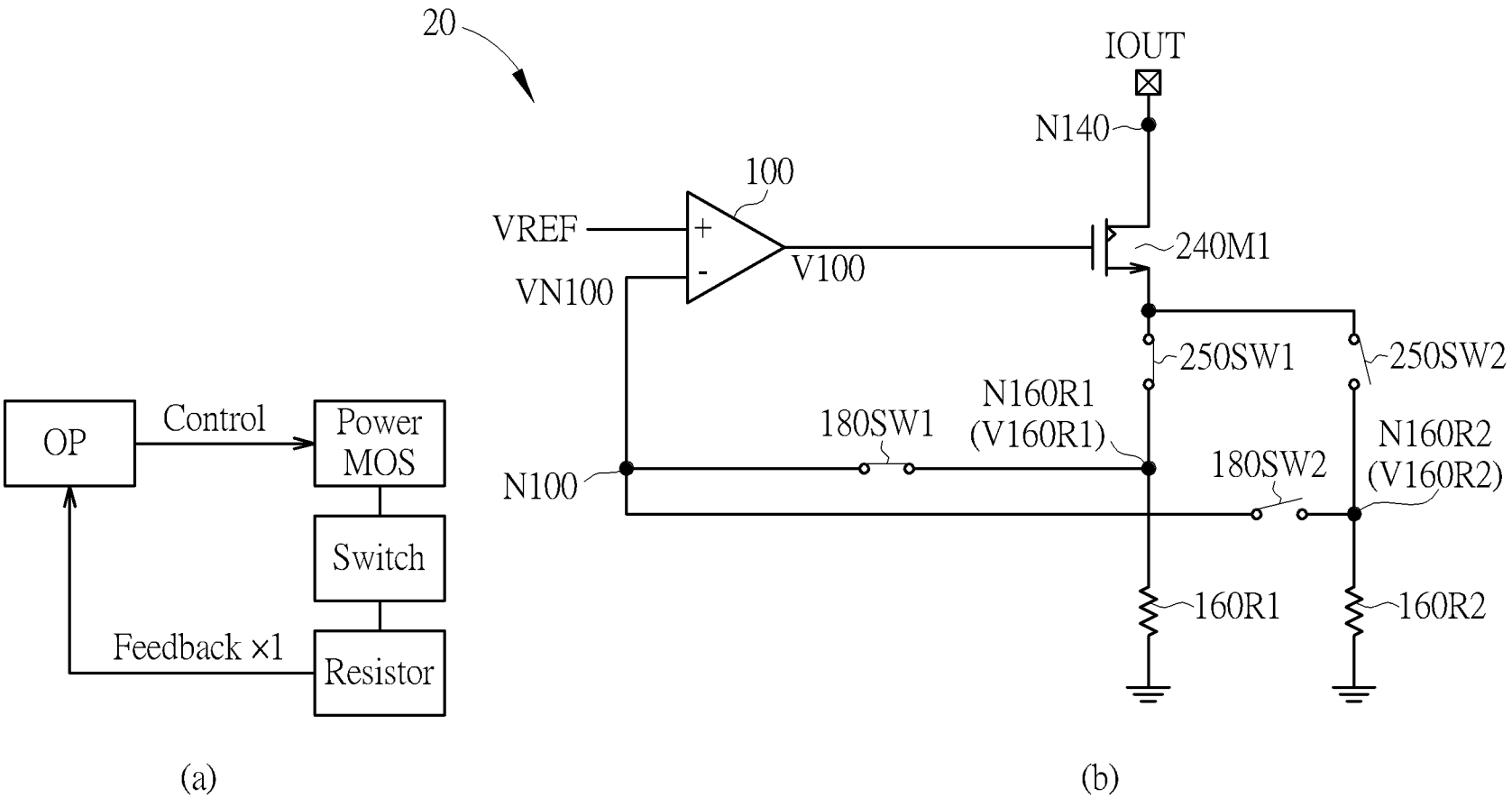

FIG. 2 is a schematic diagram of a voltage-to-current converter 20 according to an embodiment of the present invention. FIG. 2*a* illustrates a functional block diagram of the voltage-to-current converter 20. FIG. 2*b* illustrates an implementation example of the voltage-to-current converter 20.

Compared to the voltage-to-current converter 10, the voltage-to-current converter 20 further includes switches 250SW1, 250SW2. The closed switch 250SW1 or 250SW2 may short the source of a transistor 240M of the voltage-to-current converter 20 to the resistor 160R1 or 160R2, thereby altering the equivalent resistance. As a result, the node N140 is routed to the resistor 160R1 or 160R2 by the closed switch 250SW1 or 250SW2 because the transistor 240M is always turned on. The switching function of the switch 250SW1 or 250SW2 is built in (provided by) the transistors 140M1, 140M2 of the voltage-to-current converter 10, which are configured to short/disconnect the node N140 to the resistor 160R1 or 160R2.

Besides, as shown in FIG. 2, the transistors 140M1, 140M2 of the voltage-to-current converter 10 are replaced by (for example, merged into) the transistor 240M of the voltage-to-current converter 20. The transistor 240M corresponds to the resistors 160R1 and 160R2 because the output current IOUT passing through the transistor 240M may sometimes head towards both the resistors 160R1 and 160R2. The transistor 140M1 (or 140M2) however corresponds to the resistor 160R1 (or 160R2) because the current passing through the transistor 140M1 (or 140M2) heads towards the resistor 160R1 (or 160R2). The area of the transistor 240M of the voltage-to-current converter 20 is thus larger than the area of the transistor 140M1 or 140M2 of the voltage-to-current converter 10.

In addition to the transistor 240M, the switches 250SW1, 250SW2 make the area of the voltage-to-current converter 20 larger than the area of the voltage-to-current converter 10. A switch (for instance, the switch 250SW1 or 250SW2) connected to the source of a transistor (for instance, the transistor 240M) to control the flow of the (fairly large) current (for instance, the output current IOUT) is completely different (in area, function, and so on) from another switch connected to the gate of the transistor to control the gate voltage. The switch 250SW1 or 250SW2 (connected to the source of the transistor 240M) is within the current path; therefore, the switch 250SW1 or 250SW2 must have larger area through which the output current IOUT can travel.

Moreover, the switches 250SW1, 250SW2 make the area of the voltage-to-current converter 20 even larger than the area of the voltage-to-current converter 10. As the output current IOUT of the voltage-to-current converter 20 flows through the transistor 240M, the closed switch 250SW1 (or 250SW2), and the resistor 160R1 (or 160R2), the closed switch 250SW1 or 250SW2 may play a significant role in the total resistance between the node N140 and the ground. In other words, the resistance of the switch 250SW1 or 250SW2, which is/are disposed within the current path, may make the total resistance higher than the total resistance required by specification. The transistor 240M must be wider/larger, such that the resistance of the transistor 240M becomes smaller to meet the specification requirements of the total resistance between the node N140 and the ground. On the other hand, the switches 250SW1, 250SW2 are absent from the voltage-to-current converter 10; as a result, the output current IOUT of the voltage-to-current converter 10 entering the node N140 passes merely through the transistor 140M1 or 140M2 before going to the resistor 160R1 or 160R2, thereby meeting the specification requirements of the total resistance between the node N140 and the ground without further adjusting the area of the transistor 140M1 or 140M2. The area of the transistor 240M of the voltage-to-current converter 20 may consequently be larger than the total area of the transistors 140M1 and 140M2 of the voltage-to-current converter 10.

For example, if the effective area of the voltage-to-current converter 20 is 3N (assuming that the effective areas of the switches 250SW1, 250SW2 and the transistor 240M are N respectively), the effective area of the voltage-to-current converter 10 in identical headroom condition may be equal to 2N/3 (namely, $1/(1N+\frac{1}{2}\times N)=2\times N/3$). That is, the effective area of the voltage-to-current converter 10 is about 22% of the effective area of the voltage-to-current converter 20, and hence is much smaller than that of the voltage-to-current converter 20.

The mismatch between the switches 250SW1 and 250SW2 of the voltage-to-current converter 20 may reduce the accuracy/precision of the voltage-to-current converter 20. If the switches 250SW1 and 250SW2 are mismatched, the resistance of the closed switch 250SW1 is different from that of the closed switch 250SW2. The output current IOUT cannot flow evenly/appropriately to/through the closed switches 250SW1 and 250SW2 as expected. There may be a current travel through the closed switches 180SW1, 180SW2 (from the terminal N160R1 to the terminal N160R2 and vice versa). The voltage V160R1 at the terminal N160R1 of the resistor 160R1, and the voltage V160R2 at the terminal N160R2 of the resistor 160R2 (and/or the node voltage VN100 applied to the negative input terminal of the operational amplifier 100) may thus be different. As a result, the node voltage VN100 at the negative input terminal of the operational amplifier 100 is not correct/satisfied/suitable (as expected) when the switches 250SW1, 250SW2, 180SW1, 180SW2 are turned on, resulting in a decrease in accuracy/precision.

Figure 3A:
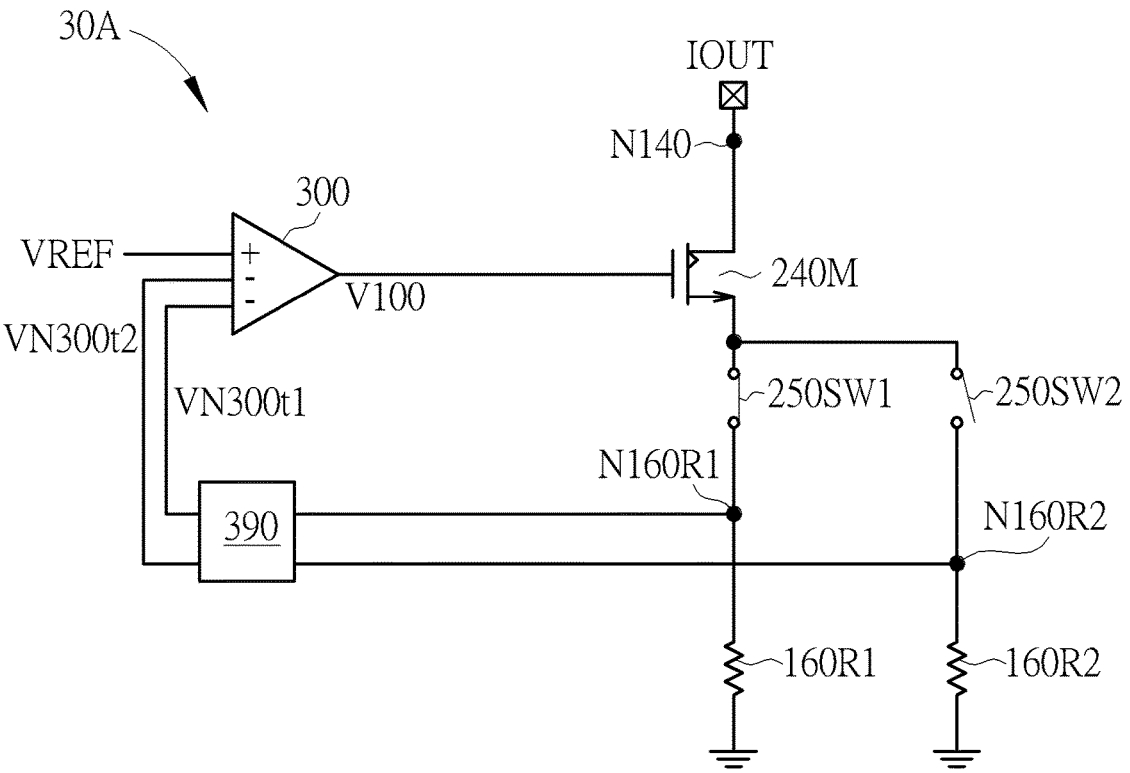

To improve the accuracy drop caused by the mismatch between the switches 250SW1 and 250SW2, please refer to FIG. 3A, which is a schematic diagram of a voltage-to-current converter 30A according to an embodiment of the present invention. Compared to the voltage-to-current converter 20, the voltage-to-current converter 30A further includes a determination circuit 390. Additionally, an operational amplifier 300 of the voltage-to-current converter 30A has two negative input terminals, which is distinct from the operational amplifier 100 of the voltage-to-current converter 10 or 20.

The determination circuit 390 is configured to determine the voltage VN300*t*1 applied to a second/negative input terminal of the operational amplifier 300 and the voltage VN300*t*2 applied to the other negative input terminal (also referred to as the third input terminal) of the operational amplifier 300. When the switches 250SW1, 250SW2 are all turned on, the first output terminal of the determination circuit 390 passes the voltage V160R1 at the terminal N160R1 of the resistor 160R1 to the second/negative input terminal of the operational amplifier 300, and the second output terminal of the determination circuit 390 passes the voltage V160R2 at the terminal N160R2 of the resistor 160R2 to the third/negative input terminal of the operational amplifier 300. When the switch 250SW1 is turned on but the switch 250SW2 is turned off, the first output terminal and the second output terminal of the determination circuit 390 pass the voltage V160R1 at the terminal N160R1 to the second/negative input terminal and the third/negative input terminal of the operational amplifier 300 respectively. When the switch 250SW1 is turned off but the switch 250SW2 is turned on, the first output terminal and the second output terminal of the determination circuit 390 pass the voltage V160R2 at the terminal N160R2 to the second/negative input terminal and the third/negative input terminal of the operational amplifier 300 respectively. In other words, the switching function of the switch 180SW1, 180SW2 of the voltage-to-current converter 10 or 20 may be provided by the determination circuit 390 of the voltage-to-current converter 30A, which is configured to control the transmission path of the voltage V160R1 or V160R2.

The operational amplifier 300 processes the voltage VN300*t*1 applied to the second/negative input terminal and the voltage VN300*t*2 applied to the third/negative input terminal with respect to the reference voltage VREF applied to the positive input terminal such that the output current IOUT is unaffected by the mismatch between the switches 250SW1 and 250SW2. For example, the operational amplifier 300 may average the voltage VN300*t*1 (at the second/negative input terminal) and the voltage VN300*t*2 (at the third/negative input terminal) out. The presence of negative feedback establishes an equivalence between the reference voltage VREF applied to the positive input terminal and the average of the voltages VN300*t*1 and VN300*t*2 applied to the negative input terminals (namely, VREF=(VN300*t*1+VN300*t*2)/2). In some embodiment, the average of the voltages VN300*t*1 and VN300*t*2 is a function of (for instance, equal to) the average of the voltages V160R1 and V160R2, when the voltage V160R1 at the terminal N160R1 and the voltage V160R2 at the terminal N160R2 are provided to/toward the second/negative input terminal and the third/negative input terminal of the operational amplifier 300 respectively. In this way, the output current IOUT is unaffected by the mismatch between the switches 250SW1 and 250SW2, thereby improving the accuracy/precision of the voltage-to-current converter 30A.

Figure 4:
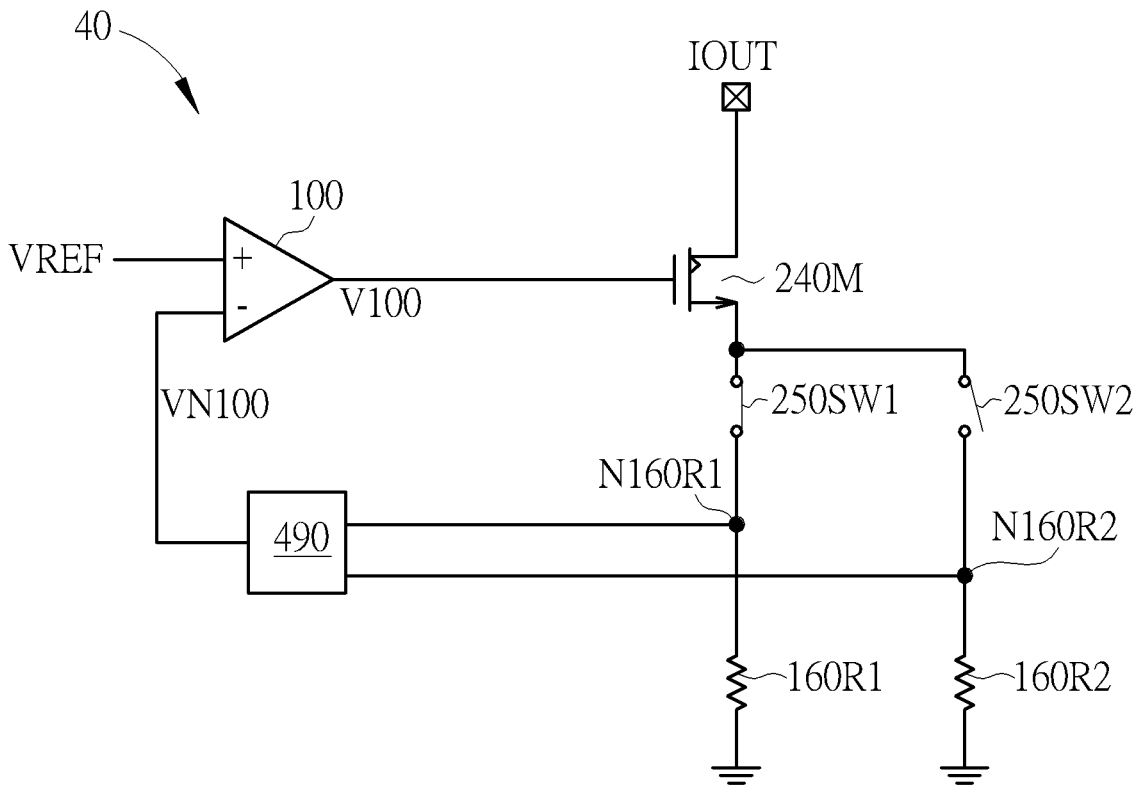

To improve the accuracy drop caused by the mismatch between the switches 250SW1 and 250SW2, please alternatively refer to FIG. 4, which is a schematic diagram of a voltage-to-current converter 40 according to an embodiment of the present invention. Compared to the voltage-to-current converter 20, the voltage-to-current converter 40 further includes a determination circuit 490.

The determination circuit 490 is configured to determine the voltage applied to the negative input terminal of the operational amplifier 100. The switching function of the switches 180SW1, 180SW2 of the voltage-to-current converter 10 or 20 may be provided by the determination circuit 490 of the voltage-to-current converter 40, which is configured to control the transmission path of the voltage V160R1 or V160R2. When the switch 250SW1 is turned on but the switch 250SW2 is turned off, the output terminal of the determination circuit 490 passes the voltage V160R1 at the terminal N160R1 of the resistor 160R1 to the negative input terminal of the operational amplifier 100. When the switch 250SW1 is turned off but the switch 250SW2 is turned on, the output terminal of the determination circuit 490 passes the voltage V160R2 at the terminal N160R2 of the resistor 160R2 to the negative input terminal of the operational amplifier 100.

When the switches 250SW1, 250SW2 are all turned on, the determination circuit 490 processes/outputs the node voltage VN100 according to the voltage V160R1 at the terminal N160R1 of the resistor 160R1 and the voltage V160R2 at the terminal N160R2 of the resistor 160R2 so as to resolve the mismatch between the switches 250SW1 and 250SW2. For example, the determination circuit 490 may average the voltage V160R1 at the terminal N160R1 and the voltage V160R2 at the terminal N160R2 out, and then output the average (namely, (V160R1+V160R2)/2) to the negative input terminal of the operational amplifier 100. Alternatively, the determination circuit 490 may calculate a combination voltage of the voltage V160R1 across the resistor 160R1 and the voltage V160R2 across the resistor 160R2 according to the ratio of the resistance of the resistor 160R1 to the resistance of the resistor 160R2, and then output the combination voltage (after being weighted) to the negative input terminal of the operational amplifier 100. (For instance, the combination voltage may be equal to (V160R1+V160R2)/2 when the resistance of the resistor 160R1 is equal to the resistance of the resistor 160R2. The combination voltage may be equal to (V160R1+2×V160R2)/3 when the resistance (referred to as r160R1) of the resistor 160R1 and the resistance (referred to as r160R2) of the resistor 160R2 satisfy r160R1=2×r160R2.) In other words, the node voltage VN100 output from the determination circuit 490 to the operational amplifier 100 is a function of the voltages V160R1, V160R2, the resistance of the resistor 160R1, and/or the resistance of the resistor 160R2. In this way, the output current IOUT is unaffected by the mismatch between the switches 250SW1 and 250SW2, thereby improving the accuracy/precision of the voltage-to-current converter 40.

Similar to the mismatch between the switches 250SW1 and 250SW2 of the voltage-to-current converter 20, the mismatch between the transistors 140M1 and 140M2 of the voltage-to-current converter 10 may reduce the accuracy/precision of the voltage-to-current converter 10. If the transistors 140M1 and 140M2 are mismatched, the voltage V160R1 at the terminal N160R1 of the resistor 160R1 may differ from the voltage V160R2 at the terminal N160R2 of the resistor 160R2. As a result, the node voltage VN100 at the negative input terminal of the operational amplifier 100 is not correct/desirable when the transistors 140M1, 140M2 and the switches 180SW1, 180SW2 are turned on, resulting in a decrease in accuracy/precision.

Figure 3B:
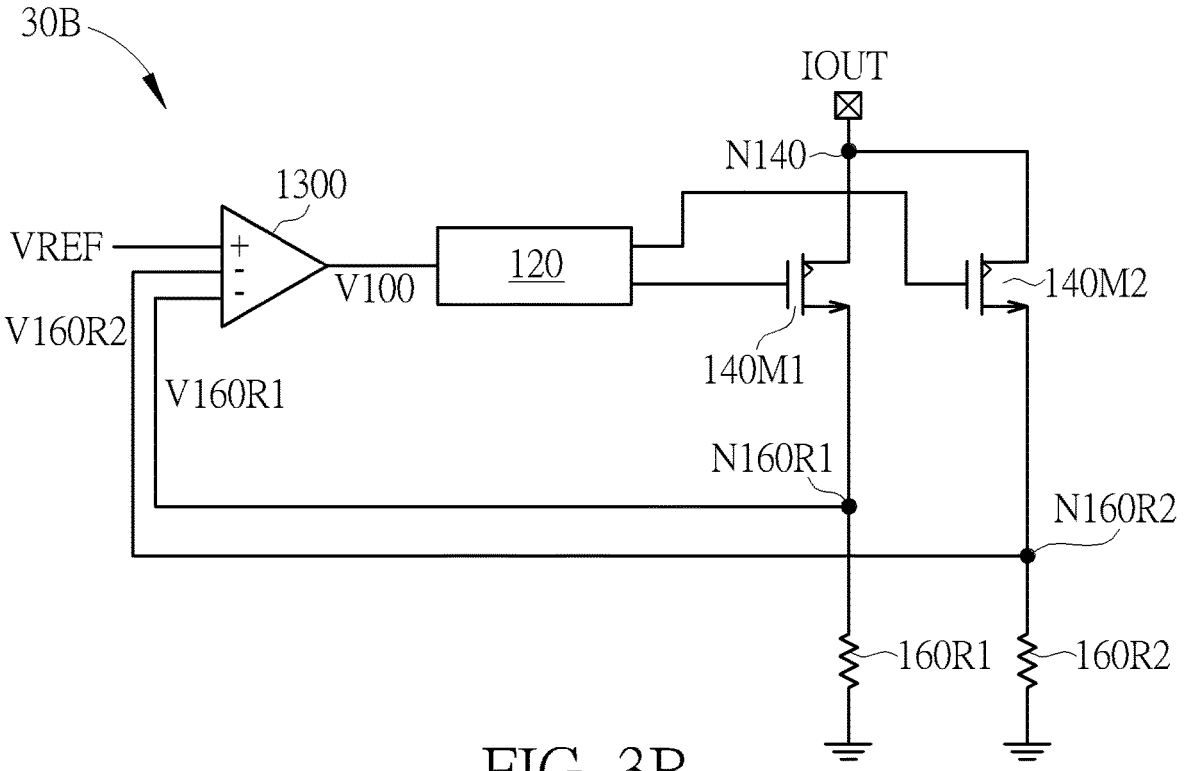

To improve the accuracy drop caused by the mismatch between the transistors 140M1 and 140M2, please refer to FIG. 3B, which is a schematic diagram of a voltage-to-current converter 30B according to an embodiment of the present invention. As shown in FIG. 3A and FIG. 3B, the voltage-to-current converter 30A may be evolved from the voltage-to-current converter 20 while the voltage-to-current converter 30B may be evolved from the voltage-to-current converter 10. As the operational amplifier 300 of the voltage-to-current converter 30A prevents the output current IOUT from being influenced by the mismatch between the switches 250SW1 and 250SW2, an operational amplifier 1300 of the voltage-to-current converter 30B is configured to resolve the mismatch between the transistors 140M1 and 140M2.

The operational amplifier 1300 processes the voltage V160R1 applied to a second/negative input terminal of the operational amplifier 1300 and the voltage V160R2 applied to a third/negative input terminal of the operational amplifier 1300 such that the output current IOUT is unaffected by the mismatch between the transistors 140M1 and 140M2. When the transistor 140M1 is turned on but the transistor 140M2 is turned off, the operational amplifier 1300 outputs the output voltage V100 in response to the voltage V160R1 applied to the second/negative input terminal and the reference voltage VREF applied to a positive input terminal of the operational amplifier 1300. When the transistor 140M1 is turned off but the transistor 140M2 is turned on, the operational amplifier 1300 outputs the output voltage V100 in response to the voltage V160R2 applied to the third/negative input terminal and the reference voltage VREF.

When the transistors 140M1 and 140M2 are all turned on, the operational amplifier 1300 processes the voltage V160R1 applied to the second/negative input terminal and the voltage V160R2 applied to the third/negative input terminal so as to resolve the mismatch between the transistors 140M1 and 140M2. For example, the operational amplifier 1300 may average the voltages V160R1 and V160R2 out, and then send out the output voltage V100 in response to the reference voltage VREF and the average (namely, (V160R1+V160R2)/2). Alternatively, the operational amplifier 1300 may calculate a combination voltage of the voltages V160R1 and V160R2 according to the ratio of the resistance of the resistor 160R1 to the resistance of the resistor 160R2, and then send out the output voltage V100 in response to the reference voltage VREF and the combination voltage. In this way, the output current IOUT is unaffected by the mismatch between the transistors 140M1 and 140M2, thereby improve the accuracy/precision of the voltage-to-current converter 30B.

In a word, the operational amplifier 1300 outputs the output voltage V100 in response to the reference voltage VREF applied to its positive input terminal and the combination of the voltages V160R1 and V160R2 of all the resistors 160R1 and 160R2 (for example, the average of the voltages V160R1 and V160R2 of the resistors 160R1 and 160R2 corresponding to the turned-on transistors 140M1 and 140M2, or the voltage V160R1 of the resistor 160R1 corresponding to the turned-on transistor 140M1 alone).

The determination circuit 390 shown in FIG. 3A is absent from the voltage-to-current converter 30B shown in FIG. 3B. The operational amplifier 1300 in FIG. 3B may provide the functions of the determination circuit 390 and the operational amplifier 300 shown in FIG. 3A, and hence may replace the determination circuit 390 and the operational amplifier 300.

Specifically, there is difference between the operational amplifiers 300 and 1300. The number of input finger(s) of the operational amplifier 1300 may be variable. The operational amplifier 1300 may determine how many input fingers for the positive input terminal of the operational amplifier 1300 are. For example, the operational amplifier 1300 may determine how many transistors (of a differential amplifier in an input stage of the operational amplifier 1300) have gates (for instance, the gate of a transistor 704M2 shown in FIG. 7) being routed to the positive input terminal of the operational amplifier 1300 to receive the reference voltage VREF. For example, when the transistors 140M1 and 140M2 are turned on, the voltages V160R1 and V160R2 are delivered to the two negative input terminals of the operational amplifier 1300. Accordingly, the number of the input finger(s) for the two negative input terminals of the operational amplifier 1300 is two; the number of the input finger(s) for the positive input terminal of the operational amplifier 1300 is two as well. When the transistor 140M1 is turned on but the transistor 140M2 is turned off, the voltage V160R1 is delivered to the (corresponding) negative input terminal of the operational amplifier 1300. Since the voltage V160R2 is zero volts, the input finger corresponding to the voltage V160R2 is unused. The number of the input finger(s) for the two negative input terminals of the operational amplifier 1300 is one. Accordingly, the (corresponding)

transistor (of the differential amplifier of the operational amplifier 1300) (for instance, a transistor 704M1 shown in FIG. 7) is turned off, such that the number of the input finger(s) for the positive input terminal of the operational amplifier 1300 is changed to one. In other words, the number of the input finger(s) for the negative input terminals is equal to the number of the input finger(s) for the positive input terminal in this embodiment. In another embodiment, the ratio of the number of the input finger(s) for the negative input terminals to the number of the input finger(s) for the positive input terminal corresponds to the weights of the voltages V160R1 and V160R2 for the combination voltage.

On the other hand, the number of input finger(s) of the operational amplifier 300 may be fixed. Gates of transistors (of a differential amplifier in an input stage of the operational amplifier 300) (for instance, the gates of transistors 704M1~704M4 shown in FIG. 7) are always routed to the positive/negative input terminals of the operational amplifier 300 respectively. The determination circuit 390 may decide which voltage is transmitted to which negative input terminal of the operational amplifier 300. For example, when the switches 250SW1 and 250SW2 are turned on, the voltages V160R1 and V160R2 are delivered to the two negative input terminals of the operational amplifier 300. Alternatively when the switch 250SW1 is turned on but the switch 250SW2 is turned off, the determination circuit 390 may pass the voltage V160R1 to all the two negative input terminals of the operational amplifier 300. Correspondingly, there are two transistors (of the differential amplifier of the operational amplifier 1300) having their gate routed to the positive input terminal of the operational amplifier 1300. As a result, the number of the input finger(s) for the two negative input terminals of the operational amplifier 300 is two; the number of the input finger(s) for the positive input terminal of the operational amplifier 1300 is two as well. In other words, the number of the input finger(s) for the negative input terminals is equal to the number of the input finger(s) for the positive input terminal.

The aforementioned voltage-to-current converters are exemplary embodiments of the present invention, and those skilled in the art may readily make different substitutions and modifications. For example, the ratio of the area of the transistor 140M1 to the area of the transistor 140M2 is a function of the ratio of the resistance of the resistor 160R1 to the resistance of the resistor 160R2. The area of the transistor 140M1 may be equal to the area of the transistor 140M2 when the resistance of the resistor 160R1 is equal to the resistance of the resistor 160R2.

Besides, when the resistance of the resistor 160R1 is equal to the resistance of the resistor 160R2, there may be two switching/routing possibilities: the transistors 140M1 and 140M2 (or the switches 250SW1 and 250SW2) are all turned on; alternatively, one of the transistors 140M1 and 140M2 (or one of the switches 250SW1 and 250SW2) is turned on. When the resistance of the resistor 160R1 is different from the resistance of the resistor 160R2, there may be three switching/routing possibilities: The transistors 140M1 and 140M2 (or the switches 250SW1 and 250SW2) are all turned on. Alternatively, the transistor 140M1 (or the switch 250SW1) is turned on, while the transistor 140M2 (or the switch 250SW2) is turned off. Alternatively, the transistor 140M1 (or the switch 250SW1) is turned off, while the transistor 140M2 (or the switch 250SW2) is turned on.

Figure 5:
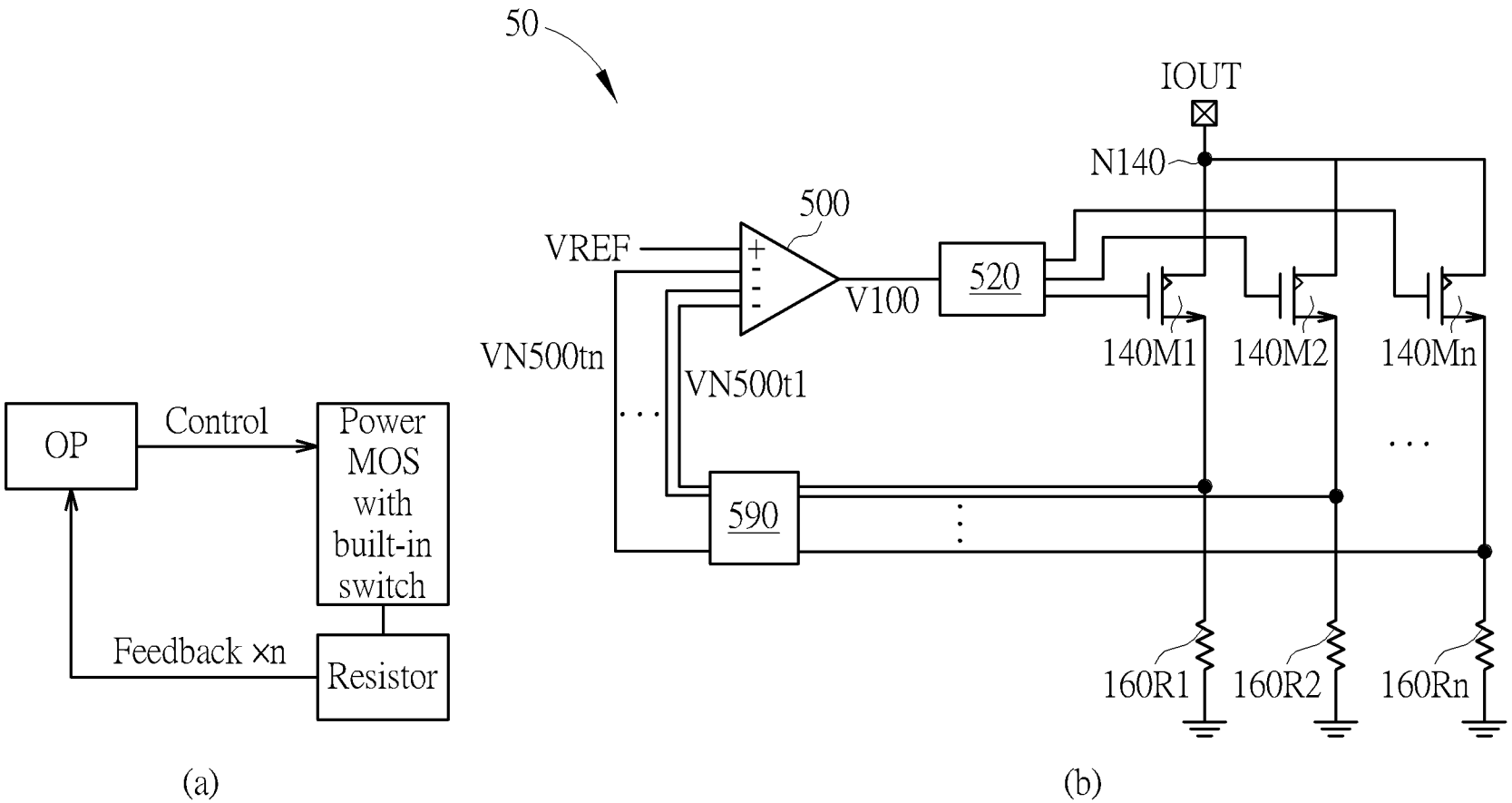

The equivalent resistance may be changed by using more resistors. For example, FIG. 5 is a schematic diagram of a voltage-to-current converter 50 according to an embodiment of the present invention. FIG. 5*a* illustrates a functional block diagram of the voltage-to-current converter 50. FIG. 5*b* illustrates an implementation example of the voltage-to-current converter 50. Compared to the voltage-to-current converter 30B, 30A, or 10, the voltage-to-current converter 50 includes resistors 160R1, . . . , 160Rn and transistor 140M1, . . . , 140Mn, where n is an integer.

Similar to the function of the control circuit 120, a control circuit 520 of the voltage-to-current converter 50 control the on/off operation of the transistors 140M1~140Mn by using the output voltage V100 so as to route the output current IOUT from the node N140 to resistor 160R1, . . . , or 160Rn.

An operational amplifier 500 of the voltage-to-current converter 50 has multiple negative input terminals. The number of the negative input terminals equals the number of the resistors 160R1~160Rn and/or the number of the transistors 140M1~140Mn. Similar to the function of the operational amplifier 300, the operational amplifier 500 processes/averages the voltages VN500*t*1—VN500*tn* applied to the negative input terminals of the operational amplifier 500. Subsequently, the operational amplifier 500 outputs the output voltage V100 in response to the reference voltage VREF applied to a positive input terminal of the operational amplifier 500 and the combination/average of the voltages VN500*t*1—VN500*tn* to improve the accuracy drop caused by the mismatch among the transistors 140M1~140Mn. In this way, the output current IOUT is unaffected by the mismatch among the transistors 140M1~140Mn, thereby improve the accuracy/precision of the voltage-to-current converter 50.

Similar to the function of the determination circuit 390, a determination circuit 590 of the voltage-to-current converter 50 is configured to determine the voltages VN500*t*1, . . . , and VN500*tn* applied to the negative input terminals of the operational amplifier 500 respectively. The determination circuit 590 may change the routes from the resistors 160R1~160Rn to the negative input terminals of the operational amplifier 500 in response to the on/off states of the transistors 140M1~140Mn. The determination circuit 590 may be removed from FIG. 5 so that the negative input terminals of the operational amplifier 500 are electrically/directly connected to the transistors 140M1~140Mn respectively, and the function of the determination circuit 390 may be served by the operational amplifier 500 as the operational amplifier 1300 of the voltage-to-current converter 30B.

Figure 6:
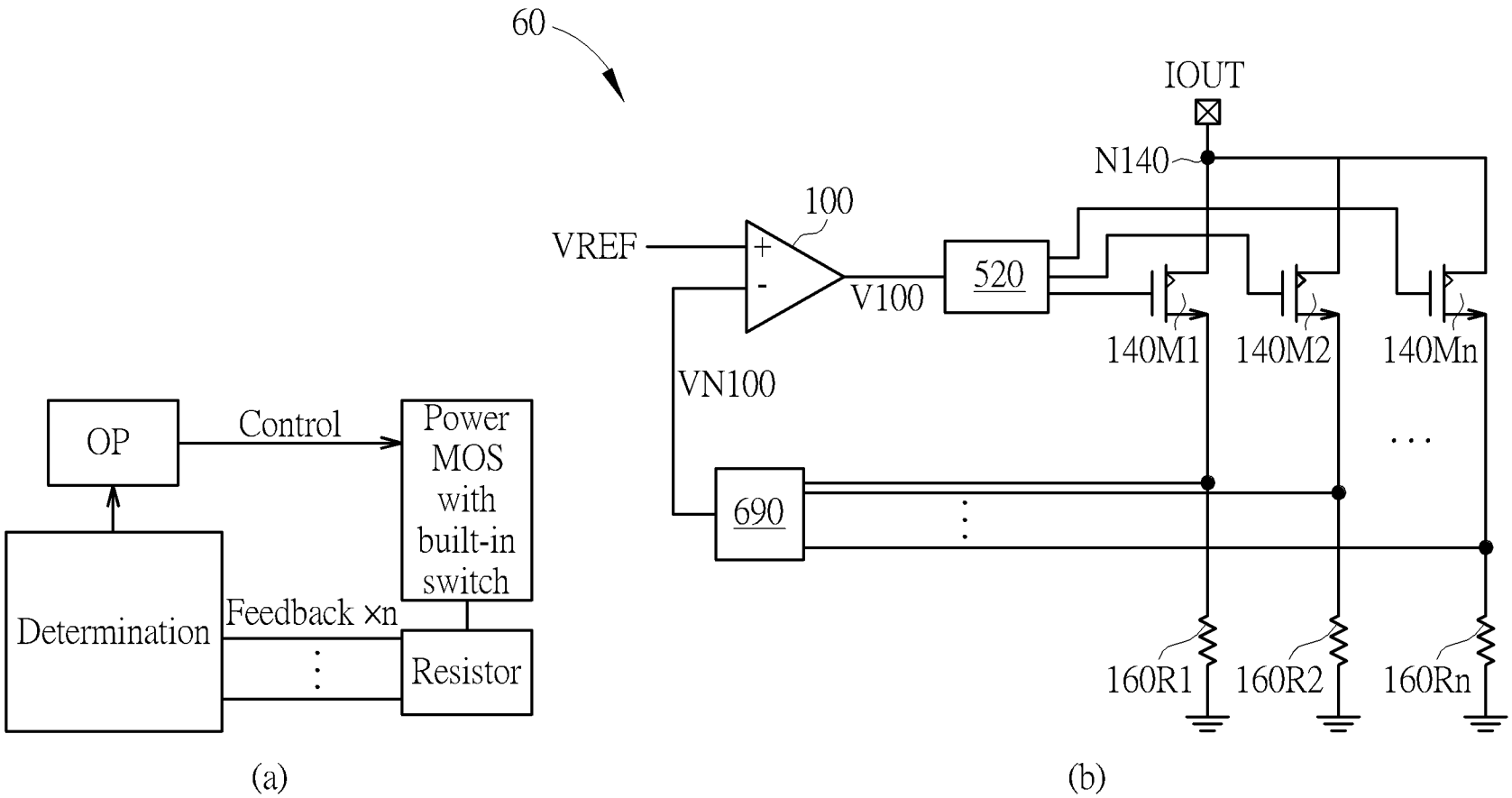

Similarly, FIG. 6 is a schematic diagram of a voltage-to-current converter 60 according to an embodiment of the present invention. FIG. 6*a* illustrates a functional block diagram of the voltage-to-current converter 60. FIG. 6*b* illustrates an implementation example of the voltage-to-current converter 60.

Compared to the voltage-to-current converter 10, 40 or 50, a determination circuit 690 of the voltage-to-current converter 60 is configured to determine the voltage applied to the negative input terminal of the operational amplifier 100 so as to improve the accuracy drop caused by the mismatch among the transistors 140M1~140Mn. For example, similar to the function of the determination circuit 490, the determination circuit 490 processes/averages the voltages across the resistors 160R1~160Rn. The node voltage VN100 output from the determination circuit 490 to the negative input terminal of the operational amplifier 100 may be a function/combination of the voltages across the resistors 160R1~160Rn and the resistances of the resistors 160R1~160Rn. For example, the combination may be the voltage across one of the resistors 160R1~160Rn, the average (namely, arithmetic mean) of the voltages across the resistors 160R1~160Rn, the geometric mean of the voltages across the resistors 160R1~160Rn, or the harmonic mean of the voltages across the resistors 160R1~160Rn, or the quadratic mean of the voltages across the resistors 160R1~160Rn, and so on. In this way, the output current IOUT is unaffected by the mismatch among the transistors 140M1~140Mn, thereby improve the accuracy/precision of the voltage-to-current converter 60.

Figure 7:
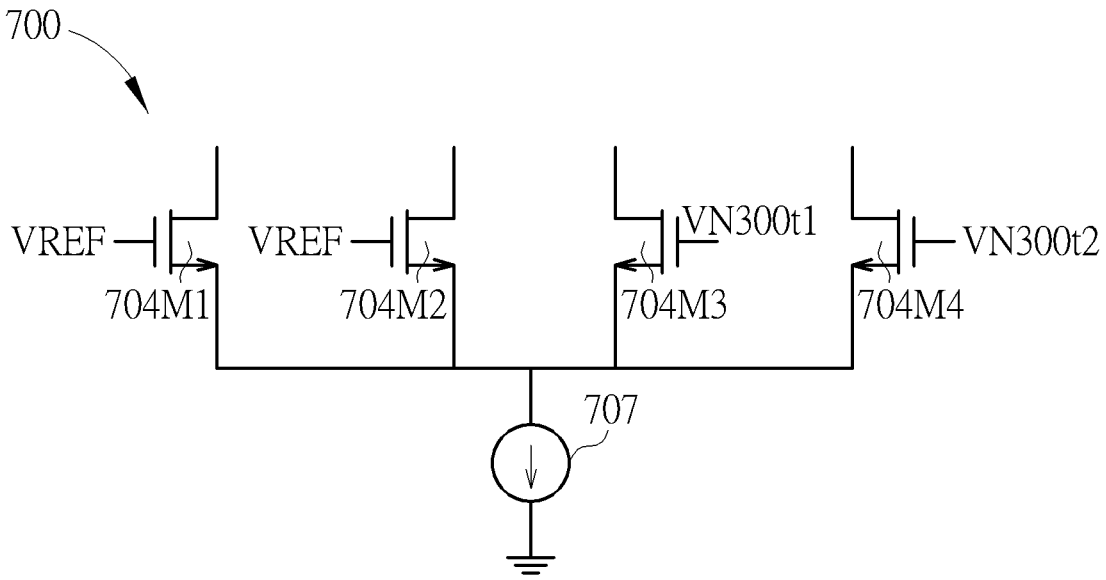
FIG. 7 is a schematic diagram of an operational amplifier according to an embodiment of the present invention.

An operational amplifier with multiple negative input terminals may be implemented in many ways. For example, FIG. 7 is a schematic diagram of an operational amplifier 700 according to an embodiment of the present invention. The operational amplifier 300 or 1300 may be replaced with the operational amplifier 700. The operational amplifier 700 may include an input stage, a gain stage, and an output stage. The input stage of the operational amplifier 700 may include a differential amplifier. The differential amplifier of the operational amplifier 700 may include transistors 704M1, . . . , 704M4 and a current source 707.

The operational amplifier 700 may have two negative input terminals to implement the operational amplifier 300 of the voltage-to-current converter 30A. The gates of the transistors 704M1, 704M2 may be connected/routed to the positive input terminal of the operational amplifier 700 to receive the reference voltage VREF. (Accordingly, the number of input finger(s) for the positive input terminal of the operational amplifier 700 may be one or two.) The gate of the transistor 704M3 may be connected/routed to the second/negative input terminal of the operational amplifier 700 to receive the voltage VN300*t*1. The gate of the transistor 704M4 may be connected/routed to the third/negative input terminal of the operational amplifier 700 to receive the voltage VN300*t*2. (Accordingly, the number of input finger(s) for the two negative input terminals of the operational amplifier 700 may be one or two.) The sources of the transistors 704M1~704M4 are connected to the current source 707.

The differential amplifier of the operational amplifier 700 may process/average the voltage VN300*t*1 applied to the second/negative input terminal and the voltage VN300*t*2 applied to the third/negative input terminal. When negative feedback is stable, the total current flowing through the transistors 704M1 and 704M2 equals the total current flowing through the transistors 704M3 and 704M4. Assuming that the transconductances of the transistors 704M1~704M4 are identical (namely, gm704M1=gm704M2=gm704M3=gm704M4), then an equation "gm704M1×VREF+gm704M2×VREF=m704M3×VN300*t*1+gm704M4×VN300*t*2" is simplified into another equation "VREF=(VN300*t*1+VN300*t*2)/2". That is, the operational amplifier 700 is able to calculate the average of the voltage VN300*t*1 applied to the second/negative input terminal and the voltage VN300*t*2 applied to the third/negative input terminal if the transconductances of the transistors 704M1-704M4 are equal.

Figure 8:
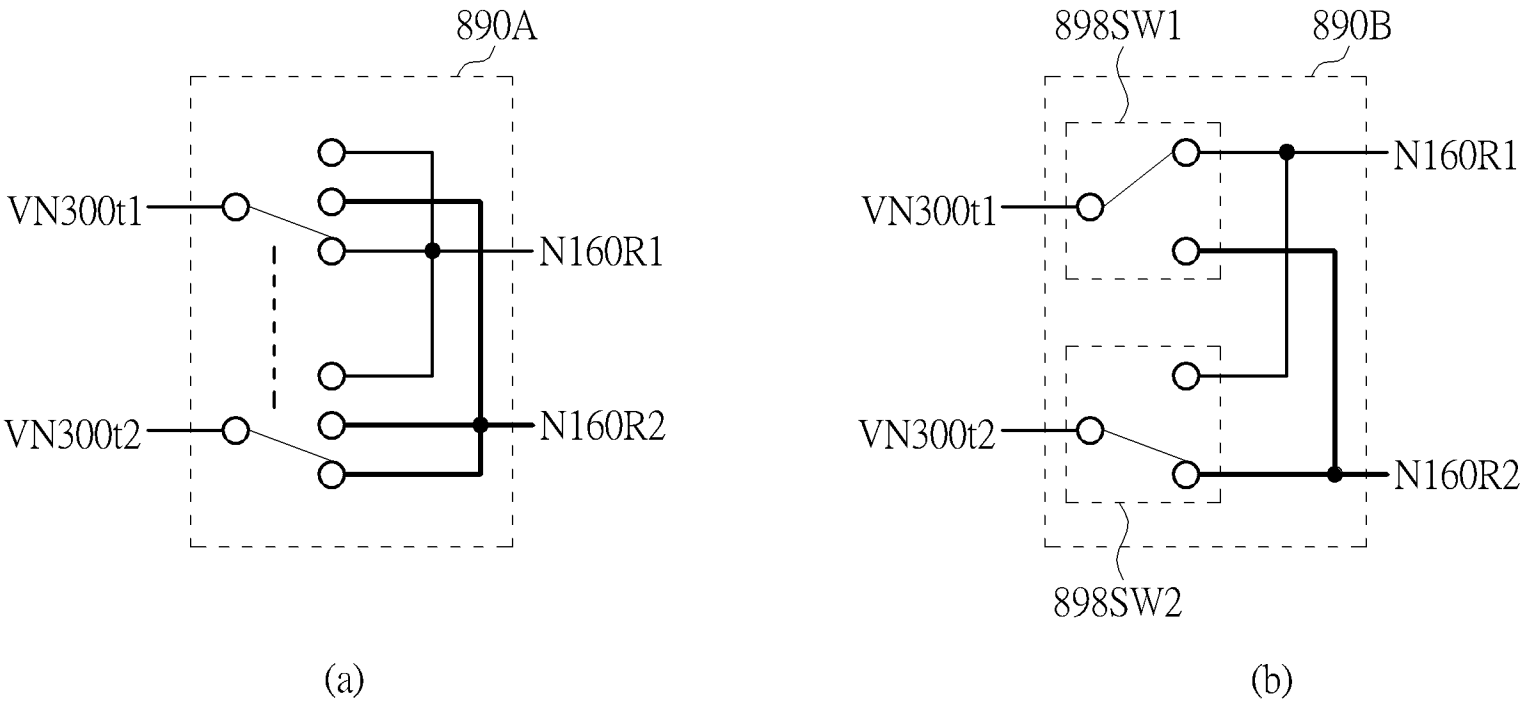
FIG. 8 is a schematic diagram of determination circuits according to embodiments of the present invention.

A determination circuit may be implemented by means of switch/switches or logic circuit(s). For example, FIG. 8 is a schematic diagram of determination circuits 890A and 890B according to embodiments of the present invention. FIG. 8*a* illustrates the determination circuit 890A; FIG. 8*b* illustrates the determination circuit 890B. The determination circuit 390 shown in FIG. 3 may be replaced with the determination circuit 890A or 890B.

The determination circuit 890A or 890B has two input terminals and two output terminals. A first input terminal of the determination circuit 890A or 890B may be connected the terminal N160R1 of the resistor 160R1 to receive the voltage V160R1. A second input terminal of the determination circuit 890A or 890B may be connected the terminal N160R2 of the resistor 160R2 to receive the voltage V160R2. A first output terminal of the determination circuit 890A or 890B may be connected the second/negative input terminal of the operational amplifier 300 to transmit the voltage VN300*t*1. A second output terminal of the determination circuit 890A or 890B may be connected the third/negative input terminal of the operational amplifier 300 to transmit the voltage VN300*t*2.

The determination circuit 890A may include a double pole three throw (DP3T) switch, while the determination circuit 890B may include two single pole double throw (SPDT) switches 898SW1 and 898SW2. The DP3T switch (alternatively, the SPDT switches 898SW1 and 898SW2) is wired up to achieve the function/purpose of the determination circuit 890A (alternatively, the determination circuit 890B). When the DP3T switch is in the up position (alternatively, when the SPDT switches 898SW1 and 898SW2 are flipped upward), the terminal N160R1 of the resistor 160R1 is routed to the second/negative input terminal and the third/negative input terminal of the operational amplifier 300. When the DP3T switch is in the middle position (alternatively, when the SPDT switches 898SW1 and 898SW2 are flipped downward), the terminal N160R2 of the resistor 160R2 is routed to the second/negative input terminal and the third/negative input terminal of the operational amplifier 300. When the DP3T switch is in the down position (alternatively, the SPDT switch 898SW1 is flipped upward and the switch SPDT 898SW2 is flipped downward), the terminal N160R1 is routed to the second/negative input terminal and the terminal N160R2 is routed to the third/negative input terminal.

Figure 9:
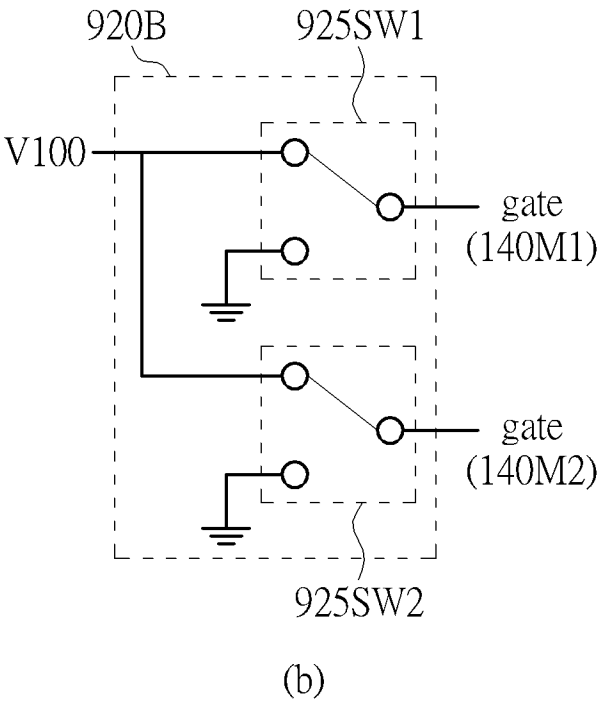
FIG. 9 is a schematic diagram of control circuits according to embodiments of the present invention.
Figure 9:
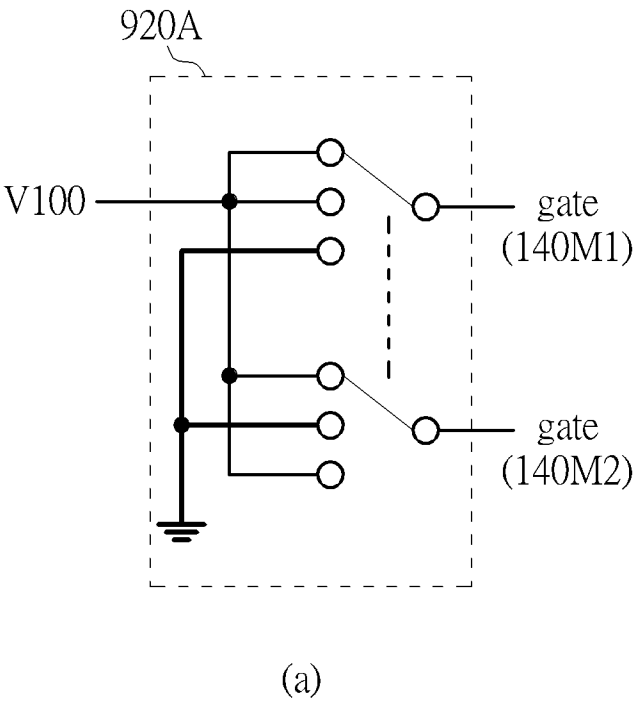

A control circuit may be implemented by means of switch/switches or logic circuit(s). For example, FIG. 9 is a schematic diagram of control circuits 920A and 920B according to embodiments of the present invention. FIG. 9*a* illustrates the control circuit 920; FIG. 9*b* illustrates the control circuit 920B. The control circuit 120 shown in FIG. 1 may be replaced with the control circuit 920A or 920B.

The control circuit 920A or 920B has one input terminal and two output terminals. The input terminal of the control circuit 920A or 920B may be connected the output terminal of the operational amplifier 100 to receive the output voltage V100. A first output terminal of the control circuit 920A or 920B may be connected the gate of the transistor 140M1. A second output terminal of the control circuit 920A or 920B may be connected the gate of the transistor 140M2. The control circuit 120A or 920B may control the gate of the transistor 140M1 or the gate of the transistor 140M2 to turn on either the transistor 140M1 or 140M2 with the output voltage V100.

The control circuit 920A may include a DP3T switch, while the control circuit 920B may include two SPDT switches 925SW1 and 925SW2. The DP3T switch (alternatively, the SPDT switches 925SW1 and 925SW2) is wired up to achieve the function/purpose of the control circuit 920A (alternatively, the control circuit 920B). When the DP3T switch is in the up position (alternatively, when the SPDT switches 925SW1 and 925SW2 are flipped upward), the output terminal of the operational amplifier 100 is routed to the gates of the transistors 140M1 and 140M2. When the DP3T switch is in the middle position (alternatively, when the SPDT switch 925SW1 is flipped upward and the SPDT switch 925SW2 is flipped downward), the output terminal of the operational amplifier 100 is routed to the gate of the transistor 140M1 but the gate of the transistor 140M2 is grounded (or connected to a lower voltage). When the DP3T switch is in the down position (alternatively, when the SPDT switch 925SW1 is flipped downward and the SPDT switch 925SW2 is flipped upward), the output terminal of the operational amplifier 100 is routed to the gate of the transistor 140M2 but the gate of the transistor 140M1 is grounded (or connected to a lower voltage). The control circuit 120 may thus switch between the transistors 140M1 and 140M2.

It is obvious to the skilled person that any other type of transistor, for example, bipolar NPN transistors, bipolar PNP transistors, or MOS transistors of N or P type, may be used to achieve the current signal switching/routing results and that any such embodiment of the present invention is equivalent to the embodiments described above and in the following claims.

In summary, a control circuit of the present invention controls the on/off operation of the transistors (each having its source connected to one resistor) so as to route the output current of the voltage-to-current converter from a node to at least one of the resistors. The output current entering the node passes through the transistor(s), configured to change the equivalent resistance by altering the route of the resistors, without flowing through extra switch before going to the resistors; therefore, the voltage-to-current converter of the present invention has smaller size and meets the specification requirements of resistance. To improve the accuracy drop caused by the mismatch between the transistors turned on, the operational amplifier of the present invention outputs voltage in response to the reference voltage applied to its positive input terminal and the average of the voltages of the resistors corresponding to the turned-on transistors.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A voltage-to-current converter, comprising:

a first transistor, having a drain coupled to a first node, wherein an output current of the voltage-to-current converter is generated from the first node;

a second transistor, having a drain coupled to the first node;

an operational amplifier, having a first input terminal configured to receive a reference voltage and a second input terminal coupled to a source of the first transistor or a source of the second transistor;

a control circuit, having an input terminal coupled to an output terminal of the operational amplifier, a first output terminal coupled to a gate of the first transistor, and a second output terminal coupled to a gate of the second transistor;

a first resistor, coupled between the source of the first transistor and a ground; and a second resistor, coupled between the source of the second transistor and the ground, wherein a resistance of the first resistor is equal to a resistance of the second resistor, and an area of the first transistor is equal to an area of the second transistor.

2. The voltage-to-current converter of claim 1, wherein the control circuit switches between the first transistor and the second transistor so as to route the first node to the first resistor or the second resistor.

3. The voltage-to-current converter of claim 1, wherein the first transistor and the second transistor are switchable to change the output current of the voltage-to-current converter, and the control circuit is configured to turn on either the first transistor or the second transistor.

4. The voltage-to-current converter of claim 1, wherein the first resistor is electrically connected to the source of the first transistor and the ground without any switch disposed between the first transistor and the first resistor or between the first resistor and the ground.

5. The voltage-to-current converter of claim 1, wherein one of the gate of first transistor or the gate of the second transistor is routed to the ground or the output terminal of the operational amplifier by the control circuit when another of the gate of first transistor or the gate of the second transistor is routed to the output terminal of the operational amplifier by the control circuit.

6. The voltage-to-current converter of claim 1, further comprising:

a first switch, coupled between the source of the first transistor and the second input terminal of the operational amplifier; or a second switch, coupled between the source of the second transistor and the second input terminal of the operational amplifier, wherein the first switch or the second switch is turned on or off when the control circuit turns on or turns off the first transistor or the second transistor.

7. The voltage-to-current converter of claim 1, wherein the output current is a function of the reference voltage, the resistance of the first resistor, or the resistance of the second resistor, a ratio of the area of the first transistor to the area of the second transistor is a function of a ratio of the resistance of the first transistor to the resistance of the second transistor, and the output current maximizes when the control circuit turns on both the first transistor and the second transistor.

8. The voltage-to-current converter of claim 1, further comprising:

a third transistor, having a drain coupled to the first node and a gate coupled to a third output terminal of the control circuit; and a third resistor, coupled between a source of the third transistor and the ground.

9. A voltage-to-current converter, comprising:

a first transistor, having a drain coupled to a first node, wherein an output current of the voltage-to-current converter is generated from the first node;

an operational amplifier, having an output terminal coupled to a gate of the first transistor and a first input terminal configured to receive a reference voltage;

a first resistor, having a first terminal coupled to a ground and a second terminal coupled to a source of the first transistor, wherein the second terminal of the first resistor is also coupled to a second input terminal of the operational amplifier or a first input terminal of a determination circuit; and a second resistor, having a first terminal coupled to the ground and a second terminal, wherein the second terminal of the second resistor is coupled to a third input terminal of the operational amplifier or a second input terminal of the determination circuit, and a resistance of the first resistor is equal to a resistance of the second resistor.

10. The voltage-to-current converter of claim 9, wherein the second input terminal of the operational amplifier receives a voltage of the second terminal of the first resistor or a voltage of the second terminal of the second resistor, the third input terminal of the operational amplifier receives the voltage of the second terminal of the first resistor or the voltage of the second terminal of the second resistor, and the output terminal of the operational amplifier outputs a voltage in response to the reference voltage and an average of the voltage of the second terminal of the first resistor and the voltage of the second terminal of the second resistor when the first transistor and a second transistor are turned on.

11. The voltage-to-current converter of claim 9, further comprising:

the determination circuit, having the first input terminal coupled to the second terminal of the first resistor, the second input terminal coupled to the second terminal of the second resistor, and a first output terminal coupled to the second input terminal of the operational amplifier, wherein the first output terminal of the determination circuit outputs a voltage of the second terminal of the first resistor, a voltage of the second terminal of the second resistor, or an average of the voltage of the second terminal of the first resistor and the voltage of the second terminal of the second resistor to the second input terminal of the operational amplifier.

12. The voltage-to-current converter of claim 9, wherein a first output terminal of the determination circuit outputs an average of a voltage of the second terminal of the first resistor and a voltage of the second terminal of the second resistor to the second input terminal of the operational amplifier when the first transistor and a second transistor are turned on, the second transistor has a drain coupled to the first node, a source coupled to the second resistor, and a gate coupled to the output terminal of the operational amplifier.

13. The voltage-to-current converter of claim 9, wherein the determination circuit has a second output terminal coupled to the third input terminal of the operational amplifier, and the second output terminal of the determination circuit outputs a voltage of the second terminal of the first resistor or a voltage of the second terminal of the second resistor to the third input terminal of the operational amplifier.

14. The voltage-to-current converter of claim 9, wherein a first output terminal of the determination circuit outputs a voltage of the second terminal of the second resistor to the second input terminal of the operational amplifier when the first transistor is turned off.

15. The voltage-to-current converter of claim 9, wherein the operational amplifier includes a differential amplifier, the differential amplifier comprises:

a first input transistor, having a source coupled to a second node and a gate coupled to the first input terminal of the operational amplifier to receive the reference voltage;

a second input transistor, having a source coupled to the second node and a gate coupled to the first input terminal of the operational amplifier to receive the reference voltage;

a third input transistor, having a source coupled to the second node and a gate coupled to the second input terminal of the operational amplifier to receive a voltage of the second terminal of the first resistor or a voltage of the second terminal of the second resistor; and a fourth input transistor, having a source coupled to the second node and a gate coupled to the third input terminal of the operational amplifier to receive the voltage of the second terminal of the first resistor or the voltage of the second terminal of the second resistor.

16. The voltage-to-current converter of claim 15, wherein a transconductance of the first input transistor, a transconductance of the second input transistor, a transconductance of the third input transistor, and a transconductance of the fourth input transistor are equal.

17. The voltage-to-current converter of claim 9, further comprising:

a third resistor, having a first terminal coupled to the ground and a second terminal, wherein the second terminal of the third resistor is coupled to a fourth input terminal of the operational amplifier or a third input terminal of the determination circuit.

18. The voltage-to-current converter of claim 9, wherein the second input terminal of the operational amplifier is coupled to the second terminal of the first resistor, the third input terminal of the operational amplifier is coupled to the second terminal of the second resistor, the output terminal of the operational amplifier outputs a voltage in response to the reference voltage and a voltage of the second terminal of the second resistor when the first transistor is turned off.

19. A voltage-to-current converter, comprising:

a first transistor, having a drain coupled to a first node, wherein an output current of the voltage-to-current converter is generated from the first node;

a second transistor, having a drain coupled to the first node;

an operational amplifier, having a first input terminal configured to receive a reference voltage;

a control circuit, having an input terminal coupled to an output terminal of the operational amplifier, a first output terminal coupled to a gate of the first transistor, and a second output terminal coupled to a gate of the second transistor;

a first resistor, having a first terminal coupled to a ground and a second terminal coupled to a source of the first transistor, wherein the second terminal of the first resistor is also coupled to a second input terminal of the operational amplifier or a first input terminal of a determination circuit; and a second resistor, having a first terminal coupled to the ground and a second terminal coupled to a source of the second transistor, wherein the second terminal of the second resistor is also coupled to a third input terminal of the operational amplifier or a second input terminal of the determination circuit, and a resistance of the first resistor is equal to a resistance of the second resistor.

* * * * *